US011753294B2

(12) United States Patent
Szeteli et al.

(10) Patent No.: US 11,753,294 B2
(45) Date of Patent: Sep. 12, 2023

(54) BORE HOLE

(71) Applicant: AS Strömungstechnik GmbH, Ostfildern (DE)

(72) Inventors: Andreas Szeteli, Filderstadt (DE); Tom Mario Fischer, Filderstadt (DE)

(73) Assignee: AS Strömungstechnik GmbH, Ostfildern (DE)

( * ) Notice: Subject to any disclaimer, the term of this patent is extended or adjusted under 35 U.S.C. 154(b) by 0 days.

(21) Appl. No.: 17/944,223

(22) Filed: Sep. 14, 2022

(65) Prior Publication Data

US 2023/0087518 A1 Mar. 23, 2023

(30) Foreign Application Priority Data

Sep. 17, 2021 (DE) ..... 102021124058.1

(51) Int. Cl.
*B65D 47/20* (2006.01)
*B65D 51/16* (2006.01)
*B67D 7/02* (2010.01)
*B67D 1/08* (2006.01)

(52) U.S. Cl.
CPC ..... *B67D 7/0294* (2013.01); *B65D 51/1616* (2013.01); *B67D 2001/0825* (2013.01)

(58) Field of Classification Search
CPC ..... B67D 7/0294; B67D 2001/0825; B67D 1/0831; B67D 7/0288; B67D 1/0802; B65D 51/1616
USPC ..... 141/351; 137/212, 588; 222/400.7
See application file for complete search history.

(56) References Cited

U.S. PATENT DOCUMENTS 3,073,358 A * 1/1963 Burt ..... B67C 3/16 141/303
3,430,820 A * 3/1969 Spencer ..... B65D 83/34 137/636.4
3,454,199 A * 7/1969 Malick ..... B67D 1/0832 222/400.7
3,464,435 A * 9/1969 Lamb ..... B67D 1/0832 137/320
3,866,626 A * 2/1975 Johnston ..... B67D 1/0831 141/54
6,357,494 B1 * 3/2002 Hahn ..... B67D 7/344 141/378

(Continued)

FOREIGN PATENT DOCUMENTS

DE 102013110020 A1 3/2015
GB 2061874 A * 5/1981 ..... B67D 1/04
WO 9849090 11/1998

*Primary Examiner* — Timothy P. Kelly
*Assistant Examiner* — Stephanie A Shrieves
(74) *Attorney, Agent, or Firm* — Michael Soderman

(57) ABSTRACT

A retrieval system for a container having a dip tube and designed to hold a liquid, with a retrieval head which can be fastened to the dip tube, so that liquid can be retrieved from or supplied to the container via the dip tube and the retrieval head. The retrieval head has a liquid channel in which the liquid retrieved from or supplied to the container is conducted. An opening is provided in the wall bounding the liquid channel, wherein when the retrieval head is fastened to the dip tube the opening is closed in such a way that it is secured against the entering of gas, and wherein when the retrieval head is unfastened from the dip tube the opening is no longer closed, so that gas enters the liquid channel via the borehole.

12 Claims, 9 Drawing Sheets

(56) References Cited

U.S. PATENT DOCUMENTS

| | | | | |
|---|---|---|---|---|
| 6,425,502 | B1 * | 7/2002 | Rauworth | B67D 7/76 137/212 |
| 8,381,768 | B2 * | 2/2013 | Hasegawa | B67D 7/0261 251/149.6 |
| 8,757,195 | B2 * | 6/2014 | Gitlin, Jr. | B67D 1/0831 222/400.7 |
| 8,925,382 | B1 * | 1/2015 | Beal | G01F 23/14 73/299 |
| 9,580,197 | B2 * | 2/2017 | Szeteli | B65B 69/0075 |
| 9,828,232 | B2 * | 11/2017 | Szeteli | B67D 7/221 |
| 10,351,412 | B2 * | 7/2019 | Szeteli | F16L 19/005 |
| 2004/0025968 | A1 * | 2/2004 | Allen | B67D 7/005 141/351 |

* cited by examiner

BORE HOLE

CROSS REFERENCE TO RELATED APPLICATIONS

This application claims the priority of DE 102021124058.1 filed on 2021 Sep. 17; this application is incorporated by reference herein in its entirety.

BACKGROUND

The invention relates to a retrieval system according to the preamble of claim 1.

Such a retrieval system is known from DE 10 2021 116 140. This retrieval system is used for filling and emptying containers, in particular barrels filled with liquid chemicals. The retrieval system comprises a retrieval head which can be fastened to a dip tube of a container. By means of the retrieval head, liquid can be retrieved from the container or liquid can be supplied to the container via the dip tube. By a displacement movement the retrieval head can be fixed in a fastened position on the dip tube. The fastened position can be controlled by means of an optical sensor to achieve a target position of the removal head on the dip tube.

Alternatively, the retrieval head can be screwed to the dip tube.

Generally, the retrieval head includes a liquid channel bounded by a wall and connected to the dip tube when the retrieval head is in the fastened position so that liquid can be retrieved from or supplied to the container via the dip tube and liquid channel.

One problem is that when the retrieval head is unfastened from the dip tube and removed after retrieving liquid from or supplying liquid to the container, a residual amount of liquid initially remains in the liquid channel due to capillary action. The liquid then only flows out of the liquid channel in an uncontrolled manner once the retrieval head has been removed. In this way, the liquid enters the environment or comes into contact with another container in an uncontrolled manner.

This poses the risk of contamination, in particular if the liquid contains specialty chemicals that are hazardous to health.

SUMMARY

The invention relates to a retrieval system (1) for a container (2) having a dip tube (5) and designed to hold a liquid (3), with a retrieval head (4) which can be fastened to the dip tube (5), so that liquid (3) can be retrieved from or supplied to the container (2) via the dip tube (5) and the retrieval head (4). The retrieval head (4) has a liquid channel (10) in which the liquid (3) retrieved from or supplied to the container (2) is conducted. An opening is provided in the wall (11) bounding the liquid channel (10), wherein when the retrieval head (4) is fastened to the dip tube (5) the opening is closed in such a way that it is secured against the entering of gas, and wherein when the retrieval head (4) is unfastened from the dip tube (5) the opening is no longer closed, so that gas enters the liquid channel (10) via the borehole (15).

DETAILED DESCRIPTION

The object of the invention is to provide a retrieval system of the type mentioned at the beginning, which has increased functionality and functional reliability.

The features of claim 1 are intended to provide a solution to this object. Advantageous embodiments of the invention and appropriate further developments are described in the dependent claims.

The invention relates to a retrieval system for a container having an dip tube and designed to hold a liquid, with a retrieval head which can be fastened to the dip tube. Liquid can be retrieved from or supplied to the container via the dip tube and the retrieval head. The retrieval head has a liquid channel in which the liquid retrieved from or supplied to the container is conducted. An opening is provided in the wall bounding the liquid channel, wherein when the retrieval head is fastened to the dip tube the opening is closed in such a way that it is secured against the entering of gas or liquid, and wherein when the retrieval head is unfastened from the dip tube the opening is no longer closed, so that gas enters the liquid channel via the opening.

The opening can have different shapes or cross-sections, such as circular, oval, polygonal, slit-shaped. In particular, the opening forms a borehole. Without limiting the generality, the following refers to an opening in the form of a borehole.

The gas that can enter the liquid channel through the unclosed borehole may in particular be formed by air, but this is not obligatory. Without limiting the generality, the following refers to gas in the form of air.

The term "closed" generally comprises an uncoupling of the opening, i.e. borehole, from gas or air, i.e. a gas-tight separation from gas- or air-carrying structures, in particular channel-like structures. The closing means provided for this purpose do not have to be arranged on the borehole itself, but must merely be spatially assigned to it.

If the retrieval head of the retrieval system according to the invention is fastened to the dip tube of a container, i.e. brought into a fastened position on the dip tube and preferably secured or locked there, the dip tube forms a continuous channel with the liquid channel, via which liquid is retrieved from or supplied to the container.

In this case, the liquid channel extends coaxially to the dip tube in the longitudinal direction of the retrieval head and the dip tube.

The borehole provided in the wall of the liquid channel of the retrieval head according to the invention is then closed so that no air can enter the liquid channel from the outside, which would impair the retrieval or supply of liquid.

The wall of the liquid channel advantageously forms a lateral surface of the liquid channel, which surface, in the fastened position of the retrieval head, is surrounded by the dip tube.

If the retrieval head is unfastened from the dip tube, the closure of the borehole is released already during unfastening of the retrieval head from its fastened position, i.e. already while the liquid channel is still in the area of the dip tube, in particular while the liquid channel still protrudes into the dip tube. The releasing of the closure of the borehole is effected solely by the displacement movement of the retrieval head relative to the dip tube. Such a displacement movement occurs both when the retrieval head is fixed to the dip tube with a pure displacement movement and when the retrieval head is screwed to the dip tube, because in this case a resulting relative displacement of the retrieval head relative to the dip tube is also obtained.

Since the closure of the borehole is released when the retrieval head is unfastened from the dip tube, air enters the liquid channel from outside via the borehole. This entry of air into the liquid channel prevents liquid from adhering to the liquid channel due to the capillary action of the liquid in the dip tube.

Thus, when the retrieval head is unfastened from the dip tube, i.e. when the liquid channel still protrudes into the dip tube, complete emptying of the liquid from the liquid channel of the retrieval head is achieved. This ensures that when the retrieval head is removed from the dip tube, there are no more liquid residues in the retrieval head, especially in the liquid channel. This prevents uncontrolled leakage of liquid from the retrieval head and the resulting adverse effects, in particular contamination of the environment.

This significantly increases the functionality and, in particular, the functional reliability of the retrieval system according to the invention. These advantages are realized with an extremely low design effort, since essentially only one borehole needs to be provided in the liquid channel of the retrieval head as an additional component.

According to an advantageous embodiment, at least one ventilation opening is provided in a wall of the dip tube, wherein the closed hole is decoupled from the ventilation opening when the retrieval head is fastened to the dip tube. When the retrieval head is unfastened from the dip tube, air passes from the ventilation opening via the borehole into the liquid channel.

In particular, a plurality of ventilation openings arranged at a distance from each other in the circumferential direction of the retrieval head can be provided.

These ventilation openings are advantageously provided for discharging outwards air introduced into and conducted through the retrieval head, which serves to ventilate the dip tube when it is being emptied.

According to the invention, the ventilation openings are used to ensure that when the retrieval head is unfastened from the dip tube, air is conducted via at least one ventilation opening into the borehole and then into the liquid channel, thereby canceling the capillary action of the liquid and consequently preventing liquid from remaining in the liquid channel when the retrieval head is unfastened from the dip tube.

If, on the other hand, the retrieval head is fastened to the dip tube, the or each ventilation opening is decoupled from the borehole so that no air enters the liquid channel via the borehole, which would impede the transfer of liquid through the liquid channel when filling or emptying the container.

Advantageously, a seal is provided on the outside of the wall bounding the liquid channel, by means of which the borehole is closed when the retrieval head is fastened to the dip tube.

The seal, which is advantageously arranged in circumferential direction around the wall bounding the liquid channel, can be used to close and release the borehole in a simple manner.

This takes advantage of the fact that the position of the seal changes relative to the position of the ventilation opening when the retrieval head is unfastened from the dip tube.

In this case, the seal is positioned relative to the borehole such that when the retrieval head is fastened to the dip tube, the seal is located between the borehole and the ventilation opening, whereby the seal prevents air from entering the borehole via the ventilation opening. Advantageously, the seal is arranged closely above the borehole.

When the retrieval head is unfastened from the dip tube, the seal is located outside the area between the ventilation opening and the borehole.

This is achieved by the relative movement of the retrieval head seal relative to the dip tube, which displaces the seal with the borehole relative to the ventilation openings.

According to a structurally advantageous embodiment, the retrieval head has a base body, wherein an upper section of the liquid channel extends in the base body and wherein a lower section protrudes downward beyond the lower edge of the base body.

At least a part of the upper section of the liquid channel is surrounded by a ventilation channel. With the dip tube fastened to the retrieval head, the dip tube's upper end encompasses the lower section of the liquid channel.

Advantageously, the borehole and the seal are arranged in the lower section of the liquid channel.

The ventilation channel is conveniently arranged concentrically to the liquid channel.

The retrieval head fastened to the dip tube conducts air introduced into the ventilation channel via a ventilation port to the outside via the ventilation opening. This prevents air from the ventilation channel from entering the liquid channel and the dip tube, which would obstruct the retrieval or filling processes.

However, when the retrieval head is unfastened from the dip tube, air from the ventilation channel enters the liquid channel and also the dip tube, thereby accelerating the discharging of liquid from the liquid channel and the dip tube.

BRIEF DESCRIPTION OF THE DRAWINGS

The invention is explained below on the basis of the drawings. The drawings show.

DETAILED DESCRIPTION OF THE PREFERRED EMBODIMENTS

Figure 1:
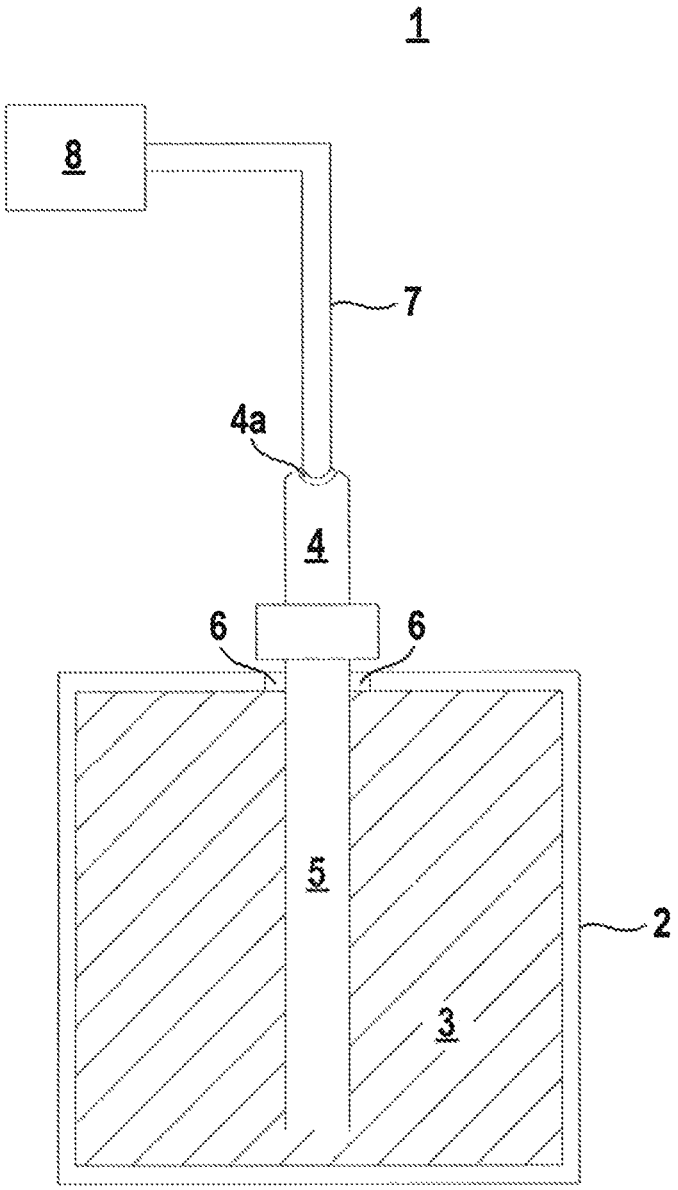
FIG. 1: A schematic representation of the retrieval system according to the invention.

FIG. 1 schematically shows an embodiment of the retrieval system 1 according to the invention for transportable containers 2, which in particular can be formed as barrels or the like. A liquid 3 is stored in the respective container 2. Liquids 3 stored in such containers 2 are in particular liquid specialty chemicals.

The retrieval system 1 comprises a retrieval head 4 which can be fastened to a dip tube 5. The dip tube 5 is supported in a bung head 6, which is seated in a container opening of the container 2, and is thus firmly connected to the container 2. The longitudinal axis of the dip tube 5 runs in a vertical direction.

The retrieval head 4 is used to retrieve liquid 3 from the container 2. Likewise, this can be used for filling containers 2. For this purpose, the retrieval head 4 has a liquid port 4*a* at its upper end. To this liquid port 4*a* a line 7 is connected, which leads to a pump 8. The line 7 can be formed as a hose. The pump 8 is controlled by a control unit not shown.

Figure 2:
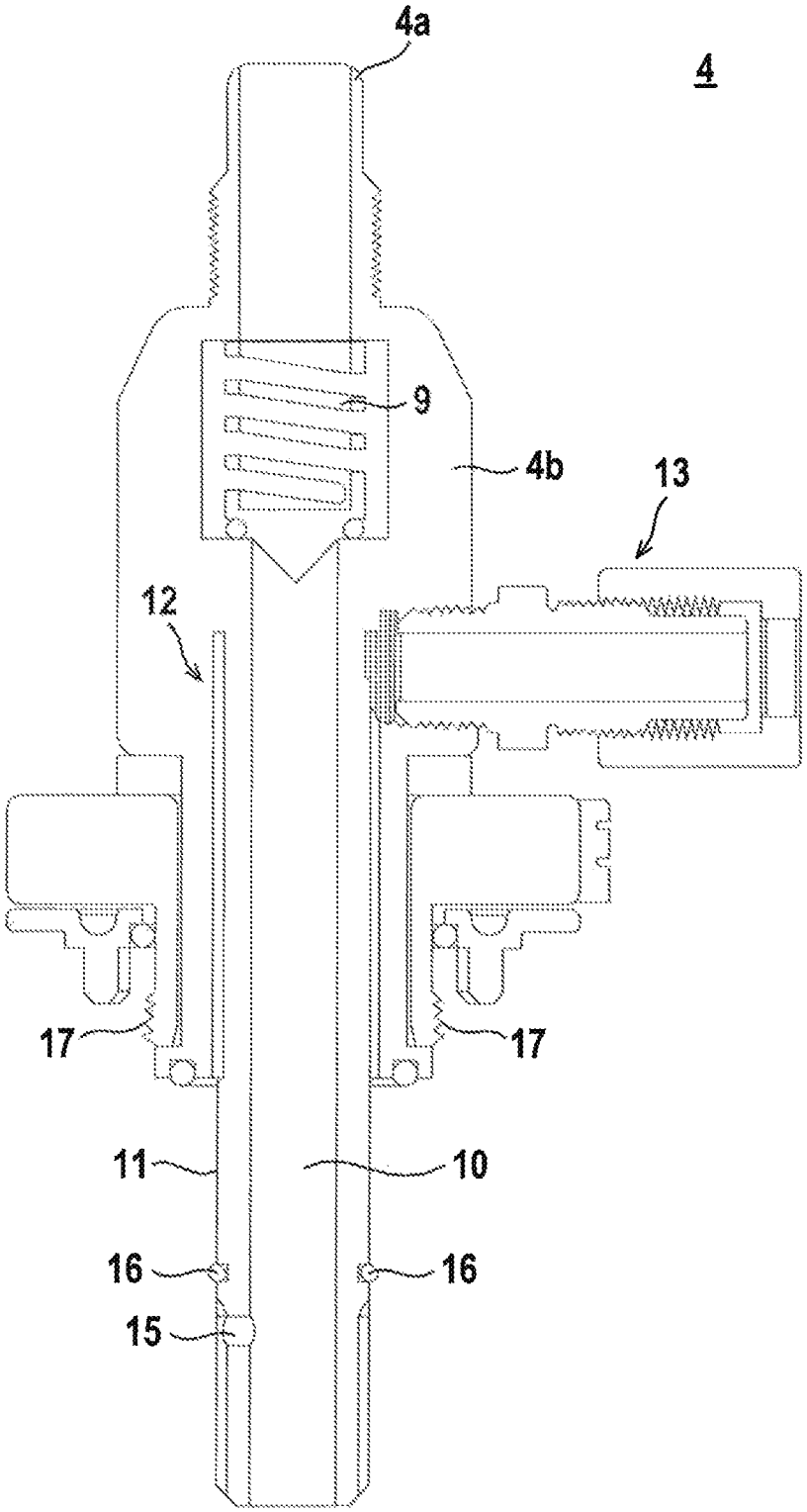
FIG. 2: An individual representation of the retrieval head of the retrieval system according to FIG. 1.

The retrieval head 4 is shown in an individual representation in FIG. 2. The retrieval head 4 has a base body 4*b* forming a housing, at the upper end of which the liquid port 4*a* is provided. Connected to the lower end is a check valve 9, which connects to the upper side of a liquid channel 10. The liquid channel 10 extends along the longitudinal axis of the retrieval head 4 and has a hollow cylindrical shape. The liquid channel 10 is bounded by a wall 11.

An upper section of the liquid channel 10 of the retrieval head 4 extends in the base body 4*b*, where it is separated from the rest of the base body 4*b* by a ventilation channel 12. The ventilation channel 12 encloses the wall 11 of the liquid channel 10. The ventilation channel 12 extends concentrically to the liquid channel 10. Air 14 is supplied to the ventilation channel 12 via a ventilation port 13 which opens out laterally on the base body 4*b* of the retrieval head 4, as can be seen in particular in FIGS. 4*b*, 5*b*, 6*b*. A lower section of the liquid channel 10 protrudes downward beyond the lower edge of the base body 4*b*.

In this lower section of the liquid channel 10, there is a borehole 15 which passes through the wall 11 of the liquid channel 10 in radial direction. A seal 16 is located closely above this borehole 15. The seal 16 runs circumferentially along the wall 11 of the liquid channel 10 and protrudes slightly beyond the outside of the wall 11.

A thread 17, with which the retrieval head 4 can be screwed to the dip tube 5, is provided at the lower end of the base body 4*b* of the retrieval head 4.

Figure 3:
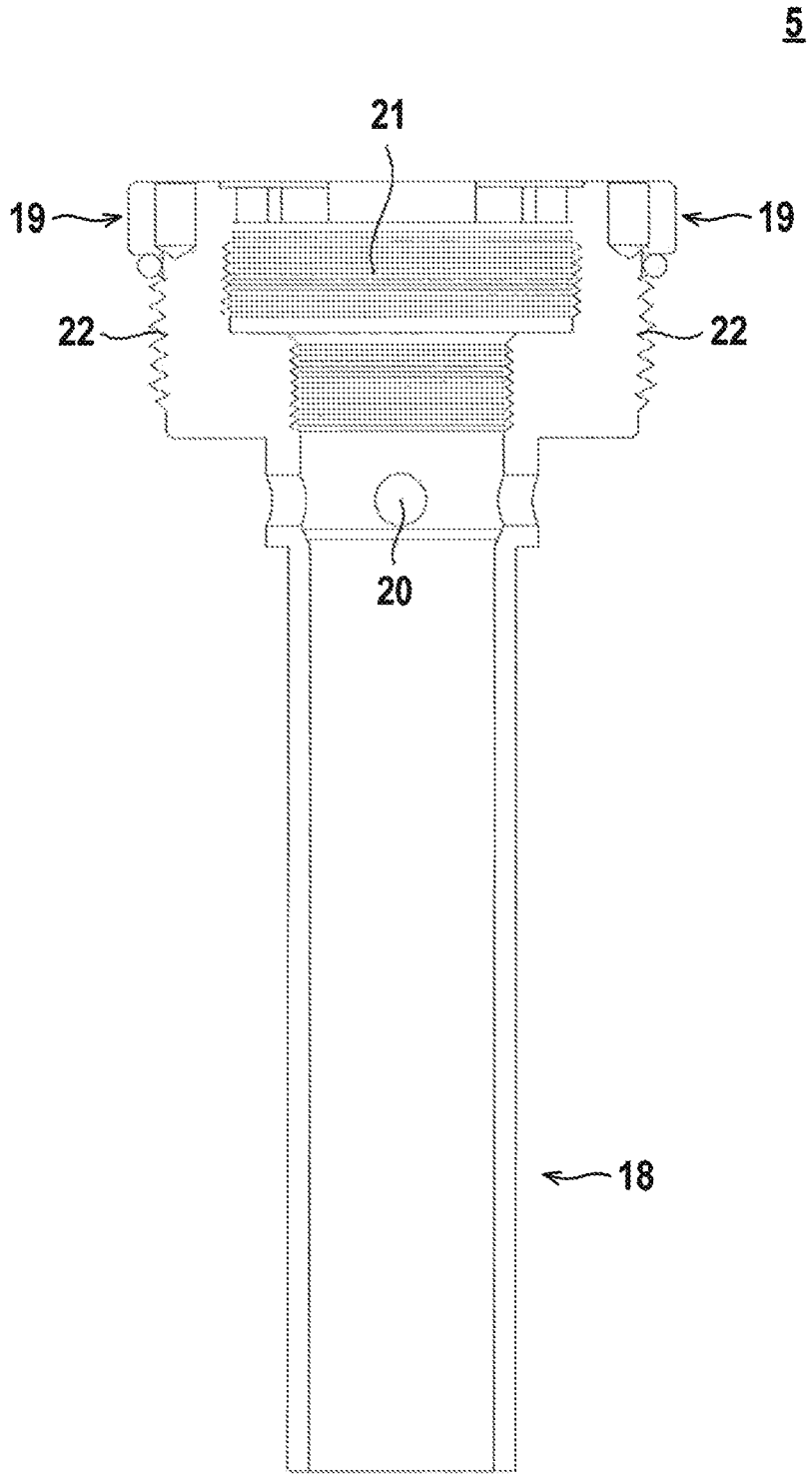
FIG. 3: An individual representation of the dip tube of the retrieval system according to FIG. 1.

The dip tube 5 is shown in an individual representation in FIG. 3. The dip tube 5 has a hollow cylindrical tube body 18 and a head part 19 at the upper side of the tube body 18.

In the area of the lower end of the head part 19, there are ventilation openings 20 which are provided equidistantly in the circumferential direction of the head part 19 at a distance from each other. In the head part 19 there is furthermore an internal thread 21 for unscrewing to the thread 17 of the retrieval head 4. Instead of a screw connection between the retrieval head 4 and the dip tube 5, other fastening options are also possible, for example in such a way that the retrieval head 4 is fixed to the dip tube 5 by a mere displacement movement. On the outside of the head part 19 there is an external thread 22 for screwing into the bung head 6.

The function of the retrieval system 1 with the retrieval head 4 on the dip tube 5 is shown in FIGS. 4*a*, 4*b*, 5*a*, 5*b*, 6*a*, 6*b*.

Figure 4A:
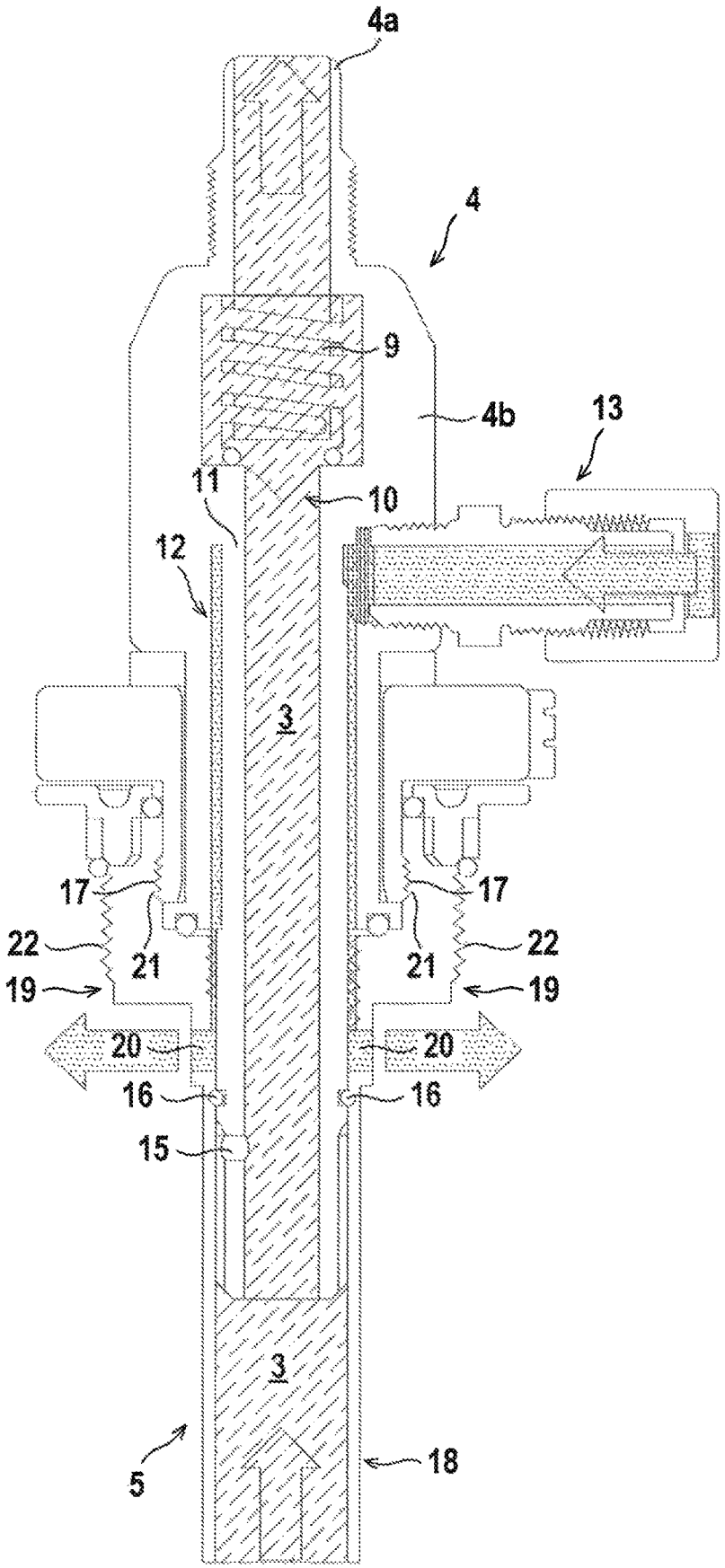
FIG. 4A: An overall representation of the retrieval head on the dip tube in its fastened position.
Figure 4B:
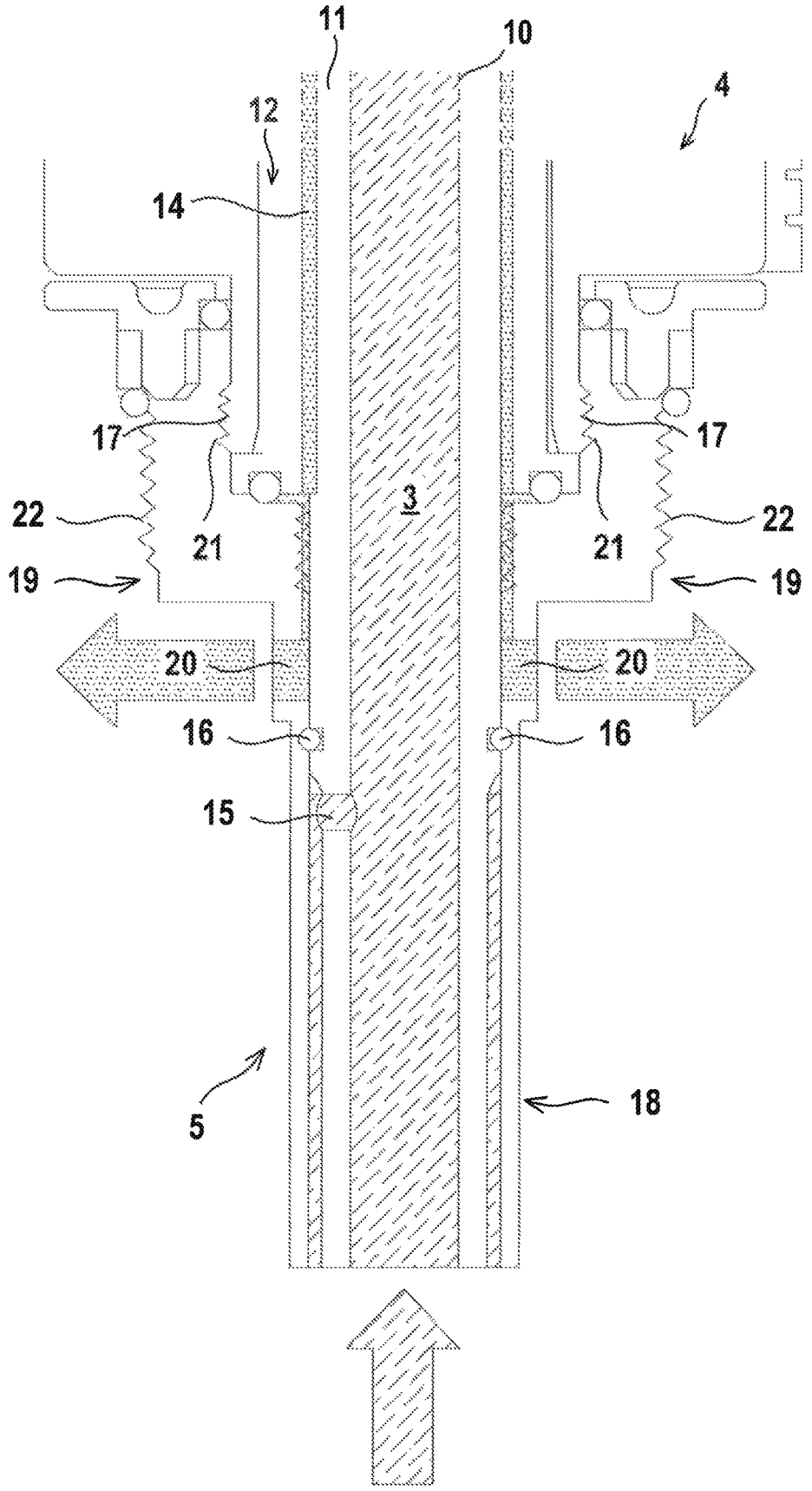
FIG. 4B: An enlarged partial representation of the retrieval head on the dip tube in its fastened position.

FIGS. 4*a*, 4*b* show the retrieval head 4 screwed to the dip ring 5. The retrieval head 4 is then in a fastened position, which may be secured by locking means and/or monitored by a sensor system.

If the retrieval head 4 is in this fastened position, liquid 3 can be retrieved from or supplied to the container 2 via the dip tube 5 and the liquid channel 10 of the retrieval head 4, which extend coaxially and connect to each other to form a common channel. Accordingly, the channel is completely filled with liquid 3 for the dispensing or introducing of liquid 3.

As FIGS. 4*a*, 4*b* show, in the fastened position, the seal 16 is arranged between the ventilation openings 20 and the borehole 15. The borehole 15 is thus closed by the seal 16. Accordingly, air 14 supplied to the ventilation channel 12 via the ventilation port 13 is exhausted via the ventilation opening 20 without this air 14 reaching the borehole 15, so that no air 14 reaches the liquid channel 10 either.

Figure 5A:
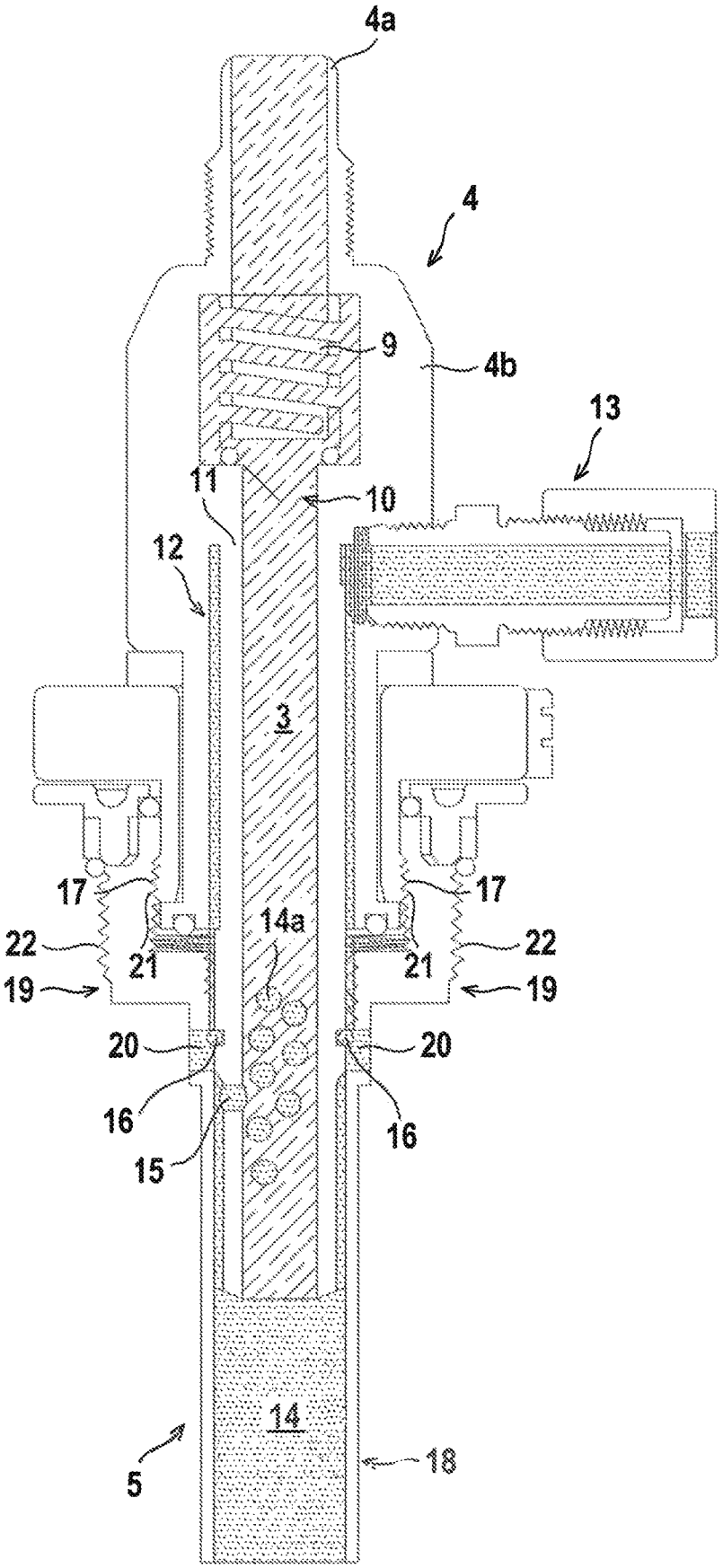
FIG. 5A: An overall representation of the retrieval head on the dip tube when released from the fastened position in a first phase.
Figure 5B:
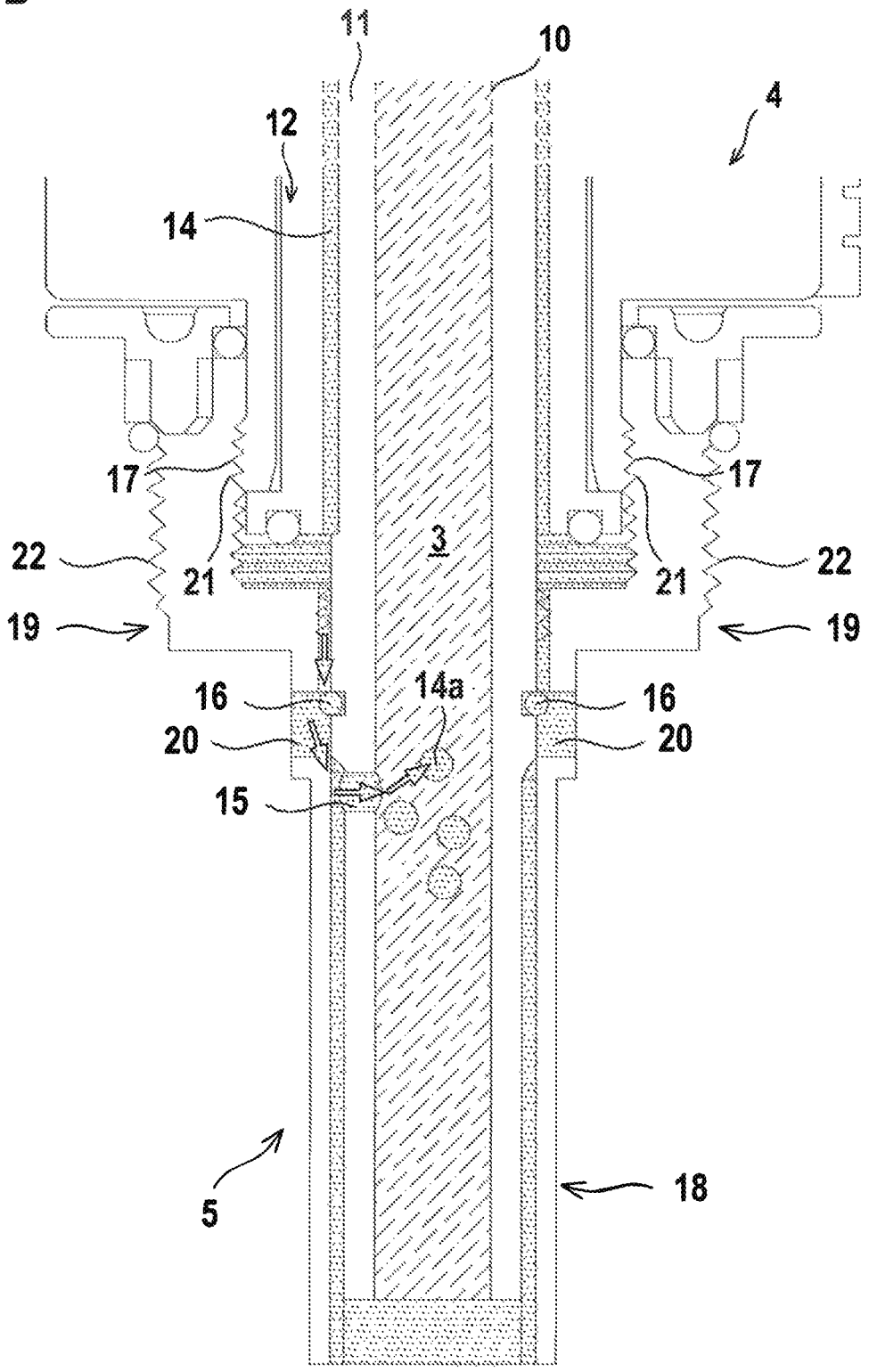
FIG. 5B: An enlarged partial representation of the retrieval head on the dip tube when released from the fastened position in a first phase.

FIGS. 5*a*, 5*b* show the situation when the retrieval head 4 is unfastened from the dip tube 5, in which the retrieval head 4 is unscrewed from the dip tube 5. In this case, the retrieval head 4 is only slightly unfastened from the fastened position, i.e., the retrieval head 4 is still supported on the dip tube 5 so that the liquid channel 10 still forms a continuous channel with the dip tube 5 to the line 7 for liquid 3.

Since the retrieval head 4 has been unscrewed somewhat from the dip tube 5, the retrieval head 4 has moved slightly in the axial direction relative to the dip tube 5. As a result of this axial movement, the seal 16 and the borehole 15 of the retrieval head 4 have moved in the axial direction relative to the ventilation openings 20 of the dip tube 5 in such a way that the seal 16 is now located in the area of the ventilation opening 20. The borehole 15 is thus no longer closed, so that air 14 now passes from the ventilation channel 12 via the area of the ventilation opening 20 to the borehole 15 and is thus conducted into the liquid channel 10. This is illustrated in FIGS. 5*a*, 5*b* by the entering of air bubbles 14*a* into the liquid 3 located in the liquid channel 10.

Figure 6A:
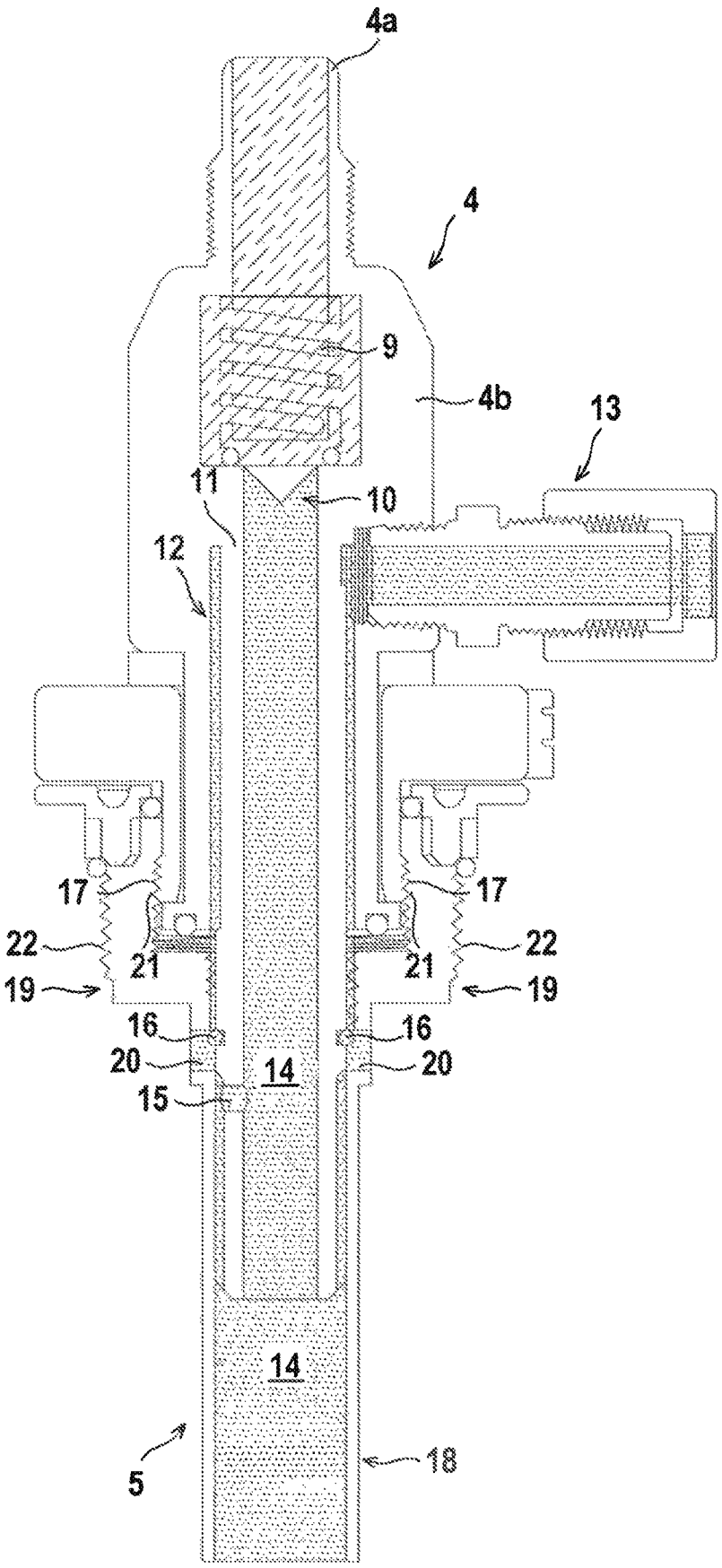
FIG. 6A: An overall representation of the retrieval head on the dip tube when released from the fastened position in a second phase.
Figure 6B:
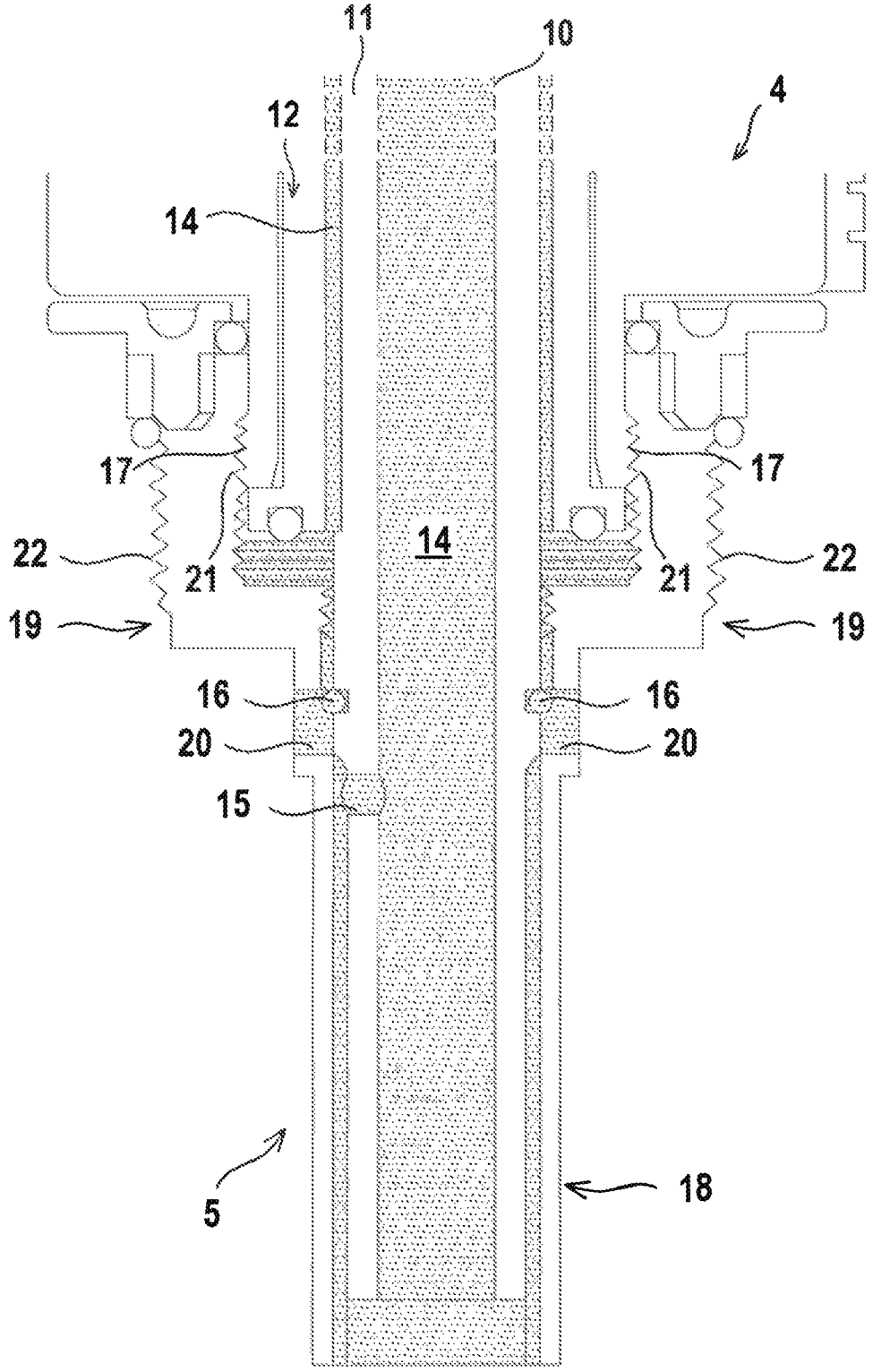
FIG. 6B: An enlarged partial representation of the retrieval head on the dip tube when released from the fastened position in a second phase.

The entering of air bubbles 14*a* prevents liquid 3 from sticking to the wall 11 of the liquid channel 10 due to capillary action. The liquid 3 thus releases quickly and completely from the wall 11, so that after a short time, as shown in FIGS. 6*a*, 6*b*, all of the liquid 3 is discharged not only from the dip tube 5 but also completely from the liquid channel 10, before the retrieval head 4 is unfastened from the dip tube 5.

LIST OF REFERENCE NUMERALS (1) Retrieval system
(2) Container
(3) Liquid
(4) Retrieval head
(4*a*) Liquid port
(4*b*) Base body
(5) Dip tube
(6) Bung head
(7) Line
(8) Pump
(9) Check valve
(10) Liquid channel
(11) Wall
(12) Ventilation channel
(13) Ventilation port
(14) Air
(14*a*) Air bubbles
(15) Borehole
(16) Seal
(17) Thread
(18) Tube body
(19) Head part
(20) Ventilation opening
(21) Internal thread
(22) External thread

The invention claimed is:

1. A retrieval system (1) comprising a container (2) having a dip tube (5) and designed to hold a liquid (3), with a retrieval head (4) which is fastenable to the dip tube (5), so that liquid (3) is retrievable from the container (2) via the dip tube (5) and the retrieval head (4) or liquid (3) is suppliable to the container (2), wherein the retrieval head (4) has a liquid channel (10) in which the liquid (3) retrieved from or supplied to the container (2) is conducted, characterized in that an opening is provided in a wall (11) bounding the liquid channel (10), wherein, when the retrieval head (4) is fastened to the dip tube (5), the opening is closed in such a way that it is secured against the entering of gas, and wherein, when the retrieval head (4) is unfastened from the dip tube (5), the opening is no longer closed, so that gas passes into the liquid channel (10) via the opening wherein at least one ventilation opening (20) is provided in the wall of the dip tube (5), wherein, when the retrieval head (4) is fastened to the dip tube (5), the closed opening is uncoupled from the ventilation opening (20), and wherein, when the retrieval head (4) is unfastened from the dip tube (5), gas passes from the ventilation opening (20) via the opening into the liquid channel (10).

2. The retrieval system (1) according to claim 1, characterized in that a seal (16) is provided on the outside of the wall (11) of the retrieval head (4) bounding the liquid channel (10), said seal causing the opening to be closed when the retrieval head (4) is fastened to the dip tube (5).

3. The retrieval system (1) according to claim 2, characterized in that the seal (16) is arranged in circumferential direction around the outside of the wall (11).

4. The retrieval system (1) according to claim 1, characterized in that when the retrieval head (4) is fastened to the dip tube (5), the seal (16) is located between the opening and the ventilation opening (20).

5. The retrieval system (1) according to claim 2, characterized in that the seal (16) is arranged closely above the opening.

6. The retrieval system (1) according to claim 1, characterized in that when the retrieval head (4) is unfastened from the dip tube (5), the retrieval head (4) is displaced in the axial direction relative to the dip tube (5), wherein this displacement movement releases the closure of the opening.

7. The retrieval system (1) according to claim 6, characterized in that when the retrieval head (4) is unfastened from the dip tube (5), due to the displacement movement of the retrieval head (4) relative to the dip tube (5), the seal (16) is moved out of the area between the opening and a ventilation opening (20).

8. The retrieval system (1) according to claim 1, characterized in that the retrieval head (4) has a base body (4*b*), wherein an upper section of the liquid channel (10) extends in the base body (4*b*) and wherein a lower section protrudes downward beyond the lower edge of the base body (4*b*).

9. The retrieval system (1) according to claim 8, characterized in that at least a part of the upper section of the liquid channel (10) is surrounded by a ventilation channel (12), and in that, when the dip tube (5) is fastened to the retrieval head (4), the upper end of the dip tube (5) surrounds the lower section of the liquid channel (10).

10. The retrieval system (1) according to claim 9, characterized in that the opening and the seal (16) are arranged in the lower section of the liquid channel (10).

11. The retrieval system (1) according to claim 9, characterized in that the ventilation channel (12) is arranged concentrically to the liquid channel (10).

12. The retrieval system (1) according to claim 9, characterized in that, when the retrieval head (4) is fastened to the dip tube (5), gas introduced into the ventilation channel (12) via a ventilation port (13) is conducted to the outside via the ventilation opening (20).

* * * * *